US006449805B2

(12) United States Patent
Slavik et al.

(10) Patent No.: US 6,449,805 B2
(45) Date of Patent: Sep. 17, 2002

(54) FOLLOW-UP SYSTEM FOR A RESERVE LAP IN A COMBING MACHINE

(75) Inventors: Walter Slavik, Fehraltorf; Thomas Zollinger, Bulach, both of (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/909,350

(22) Filed: Jul. 19, 2001

(30) Foreign Application Priority Data

Jul. 31, 2000 (DE) ..... 100 37 143

(51) Int. Cl.[7] ..... D01G 19/00
(52) U.S. Cl. ..... 19/115 R; 19/65 A; 19/65 R
(58) Field of Search ..... 19/115 R, 65 A, 19/65 R, 150, 157; 198/369.1; 242/559, 559.1

(56) References Cited

U.S. PATENT DOCUMENTS

| | | | | |
|---|---|---|---|---|
| 3,904,050 A | * | 9/1975 | Kimura et al. | 19/65 R |
| 4,890,358 A | * | 1/1990 | Marzoli | 19/115 R |
| 5,038,441 A | * | 8/1991 | Mondini et al. | 19/115 R |
| 5,121,826 A | * | 6/1992 | Scheurer | 198/369.1 |
| 5,303,453 A | * | 4/1994 | Langel et al. | 19/115 R |
| 6,059,221 A | * | 5/2000 | Broger et al. | 242/559.1 |

FOREIGN PATENT DOCUMENTS

| | | | | |
|---|---|---|---|---|
| DE | 24 34 898 | | 2/1975 | |
| DE | 197 20 545 | * | 5/1997 | B65H/67/02 |
| EP | 0118600 | | 9/1984 | |
| EP | 0381960 | | 8/1990 | |
| EP | 0593391 | | 4/1994 | |
| GB | 1 480 645 | * | 7/1973 | |
| IT | 0312 503 | * | 7/1988 | D01G/27/00 |
| JP | 63-27449 | | 6/1988 | |
| JP | OS 4-263620 | * | 4/1992 | D01G/19/08 |

OTHER PUBLICATIONS

Kämmereivorbereitung [Combing Plant], Rieter Spinning Systems.

* cited by examiner

*Primary Examiner*—Danny Worrell
*Assistant Examiner*—Gary L. Welch
(74) *Attorney, Agent, or Firm*—Frank C. Hand, Esq.; Carella, Byrne, et al.

(57) ABSTRACT

The method and an apparatus provide for the automatic provision and transfer of a reserve lap (WR) from a reserve position (RP) to a working position (AP) in a machine (K1 to K3) for processing wound laps and for the automatic discharge of an empty tube (H) from the working position (AP). The conveying system (K, 4) is provided to convey wound laps (W) or empty tubes (H) individually or in groups between a lap-processing (K1 to K3) and a lap-forming machine (KV). The control unit (8) of the conveying system (K, 4) is connected with a central control unit (ST) which is connected with the control unit (21, 22, 23) of the respective lap-processing machine (K1 to K3), with a conveyor (T) in the lap-forming machine (Ky), as well as with the control unit (20) of the lap-forming machine (Ky), and a transfer device (58, 60, 61, 63) which can be controlled via the control unit (21,22,23) of the respective lap-processing machine (K1 to K3).

7 Claims, 4 Drawing Sheets

FOLLOW-UP SYSTEM FOR A RESERVE LAP IN A COMBING MACHINE

The invention relates to a method and an apparatus for the automatic provision and transfer of a reserve lap from a reserve position to a working position in a machine for processing wound laps and for the automatic discharge of empty tubes from the working position to the delivery position for example.

In order to avoid unnecessary standstill periods in machines which process wound laps, e.g. combing machines or ribbon lap machines, it is known to keep a reserve lap on stand-by in addition to the wound laps which are being processed. Such a device is present for example in the combing machine E715 (Rieter's brochure "Kämmerei [Combing Plant]—Impressum 1403d-0991—Printed in Switzerland"). The empty tubes are transferred by hand to a collection position for a conveying system and thereafter the individual reserve laps are manually conveyed to the respective working position. This process requires a relatively high amount of time and can lead to damage to the outer web in the case of improper handling of the reserve lap.

A device is known from JP-63-27449, whereby a reserve lap is kept on stand-by behind the working lap on a downwardly inclined roll-off surface. In order to keep the reserve lap in this stand-by position, a swivelable plate is arranged in the zone of the roll-off surface which can be transferred via an adjusting mechanism from the locking position to the release position. A swivelable receiver for the empty tube which is ejected rearwardly by means of an ejection device is disposed below the roll-off surface. Said swivelable receiver is connected with the adjusting mechanism for unlocking the swivelable plate. This means that before the reserve lap is released for rolling down to the working position, the empty tube is transferred downwardly to the receiver via a pass-through opening between the roll-off surface and the working position. This device leads to the disadvantage that the reserve position is disposed relatively far at the back at a large distance from the working position. This is necessary in this embodiment, because the rearwardly ejected tube requires a certain amount of free space for delivery to the receiver. This device therefore requires much space, particularly as seen in the width, and also blocks the accessibility for maintenance work for the units which are situated in the bottom and rear areas of the combing machine. As a result of the relatively long roll-off path which the reserve lap needs to cover to the working position, damage or deformation can occur to the outer lap layer.

It was further proposed in EP-593 391 A1 to provide a swivelable bowl for the transfer of the reserve lap to the working position. This is also achieved with this device. This apparatus is provided with a swiveling device for the bowl in which the reserve lap is disposed. Furthermore, an additional receiver is provided for the rearwardly ejected empty tube. This device is temporally independent of the conveying system via which new reserve laps are supplied and empty tubes are discharged.

As a rule, however, the conveying system of the aforementioned embodiment is not charged to capacity and still has unused time reserves.

A centrally controlled lap conveying device is known from EP-381 960, with groups of laps and empty tubes being conveyed in a controlled manner by means of a crane bridge between combing machines and lap-forming machines. The method in which the empty tubes are supplied to the grippers on standby in the rails of the combing machines is not described.

From JP-OS-4-263620 a conveying system is known, with the conveying system being provided with two grippers. One of the grippers brings a reserve lap to the combing machine and is provided with a piecing apparatus for the lap end, while the second gripper removes the empty tube from the working position. This design is relatively complex and, in addition, no deposit for reserve laps is provided in the combing machine. As a result, this system is fully dependent on the availability of reserve laps from the conveying system.

A system of several combing machines with a lap-forming machine is known from JP-OS-52-25125, with the wound laps and the empty tubes being conveyed to a group by means of a conveying system (suspended conveyor) which is provided with grippers. A reserve position for receiving reserve laps is not shown. As a result, the individual combing machine can only be equipped with new wound laps once the empty tubes have been removed from their working position in the combing machine. Nothing is mentioned therein about any automatically controlled conveying system.

EP-A2 312 503 shows a conveying device for wound laps and empty tubes with an overhead conveyor with a craneway. A double gripper is provided which is used to take up the empty tube simultaneously when delivering a new wound lap to the machine. No reserve laps are shown in the machine and the empty tubes must be disposed in a special receiver, as otherwise the simultaneous exchange of the new wound lap is not possible.

EP-PS 118 600 shows a conveying device in which an additional receiver is provided on the lap carrier in order to creel the empty tubes manually for the return transport to the lap-forming machine. No automatic and effective change of the tubes can be performed with this device. A similar device is also shown in DE-OS 24 34 898 where the empty tubes are manually creeled for return transport on an additional holder on a movable gripper.

It is an object of the invention to provide a simple and cost-effective apparatus and method to follow-up reserve laps in lap-processing machines, with the smooth discharge of empty tubes being ensured and existing capacities of a conveying system being utilized optimally.

Briefly, the invention provides an apparatus and method for the automatic transfer of wound laps from a reserve position to a working position in a lap processing machine and an automatic removal of empty tubes from the machine.

In one embodiment, the apparatus comprises a lap forming machine for forming wound laps on tubes that include a control unit for operating the machine, a conveyor for receiving a plurality of wound laps from the lap forming machine and at least one combing machine having at least one working head for receiving a wound lap from the conveyor. The combing machine includes at least one transfer device for moving a wound lap from a reserve position to a working position in the working head and a control unit for operating the combing machine and for operating the transfer device;

In addition, the apparatus includes a conveying system for selectively conveying at least one wound lap from the conveyor to the combing machine and at least one empty tube from the combing machine to the conveyor. This conveying system also includes a control unit for operating system.

In accordance with the invention, a central control unit is operatively connected to each control unit for selective actuation thereof to effect movement of at least one wound lap from the lap forming machine to a reserve position in the working head, removal of an empty tube from a working position to the conveyor and movement of a wound lap from the reserve position to the working position.

The method for automatically transferring wound laps to a lap processing machine comprises the steps of actuating a conveying system to automatically place a reserve wound lap in a reserve position of the lap processing machine; thereafter monitoring the run-out of a wound lap in a working position of the lap processing machine and emitting a signal in response to the detection of an empty tube in the working position; actuating the conveying system to remove the empty tube from the working position in response to the signal; and actuating the conveying system to transfer the reserve wound lap from the reserve position to the working position.

The method further includes the step of actuating the conveying system to move a fresh wound lap into the reserve position to begin a new cycle.

In another embodiment, the conveying system is used to convey the empty tube from the working position to an intermediate position defined by the position of the reserve lap. In this embodiment, transfer of the reserve lap from the reserve position to the working position allows for an automatic transfer of the empty tube from the intermediate position into the reserve position. The conveying system is then actuated to remove the empty tube from the reserve position.

It is proposed that a conveying system is provided through which wound laps or empty tubes are conveyed individually or in groups between a lap-processing and a lapforming machine. The empty tube is taken by the conveying system directly without any intermediate storage. This allows a compact design of the combing machine as seen in the width and leads to a favorable capacity utilization of the available conveying system.

The optimization of the conveying orders is enabled by the central control unit. The connection of the central control unit with the monitoring systems in the combing machines ensures that the combing machines can be serviced in a time-optimized manner via the conveying system on the basis of the indicated times of change.

Sensor means are preferably provided in order to monitor the pull-off of the lap roll ("wound lap") disposed in the working position. This monitoring can be performed in different ways, e.g. by continual measurement of the length of the unwound web or by continuous measurement of the diameter of the wound lap.

The sensor means can also consist of a time function element which, via a roll-off mechanism produces a signal for the imminent change of lap and sends the same to the central control unit, so that the same can initiate the displacement of the conveying means depending on the entire system on time. In addition to such a sensor, a further sensor is usually provided which scans the tube surface (black/white) in order to signalize the actual pull-off of the tube. With this device, it is possible to send a signal on time to the control unit of the conveying system, so that the same is also ready during an imminent change of lap or empty tube in order to perform the change on time.

To ensure that the lap-processing machine is provided with reserve laps on time, sensor means are proposed which monitor the reserve position for the reserve laps.

The invention further provides an arrangement to facilitate the transfer of the wound lap and empty tube between the working and reserve positions of a working head of a combing machine. This arrangement includes a pair of lap rollers that define a working position for receiving a wound lap and for discharging a lap therefrom and that are rotatably mounted in a common horizontal plane as well as a receiver disposed below this plane to define a reserve position for receiving a wound reserve lap thereon. In addition, an inclined guide means extends from the working position downwardly towards the reserve position to guide an empty tube thereon towards and into the receiver and an ejection device is provided for transferring an empty tube from the working position onto the guide means.

This arrangement cooperates with the controlled conveying system for transferring a reserve lap from the reserve position into the working position and for removing an empty tube from the receiver.

As a result of this arrangement, the required space for attaching a receiver can be kept to a minimum. Only one common receiver is required for the reserve lap and the tube to be discharged. The proposed device further ensures that during the transfer of the reserve lap via the conveying system to the working position, there is an automatic and independent transfer of the tube from an intermediate position to the delivery position.

It is proposed further that an adjustable stop be provided in the zone of the guide means that can be moved into the roll-off path of the ejected empty tube in order to block movement of an empty tube towards the receiver. In addition, the stop is made to be responsive to a transfer of a reserve lap from the receiver to allow movement of the empty tube into the receiver. The stop prevents that the ejected tube from coming to rest on the circumference of the reserve lap as this could lead to damage to the outermost lap layer when the reserve lap is lifted for transfer to the working position. The proposed actuation of the stop is such that once the reserve lap has been lifted to a certain position, the blocking element is moved from the zone of the guide means and the tube is released for further transfer to the receiver.

Preferably, the guide means is in the form of a guide surface, such as a a ramp, on which the ejected tube can roll off to the receiver.

The apparatus is preferably provided on several working heads (e.g. combing heads in combing machines), as a result of which a simultaneous or groupwise change of laps can be performed in the machine.

The use of an overhead conveying system has proven advantageous as a conveying means for transferring the reserve laps and the discharge of the empty tubes. In this way, the surface space required can be kept to a minimum in the spinning room and the existing conveying capacities can be utilized optimally.

Further advantages are explained by reference to the embodiments shown in the enclosed drawings, wherein.

Figure 1:
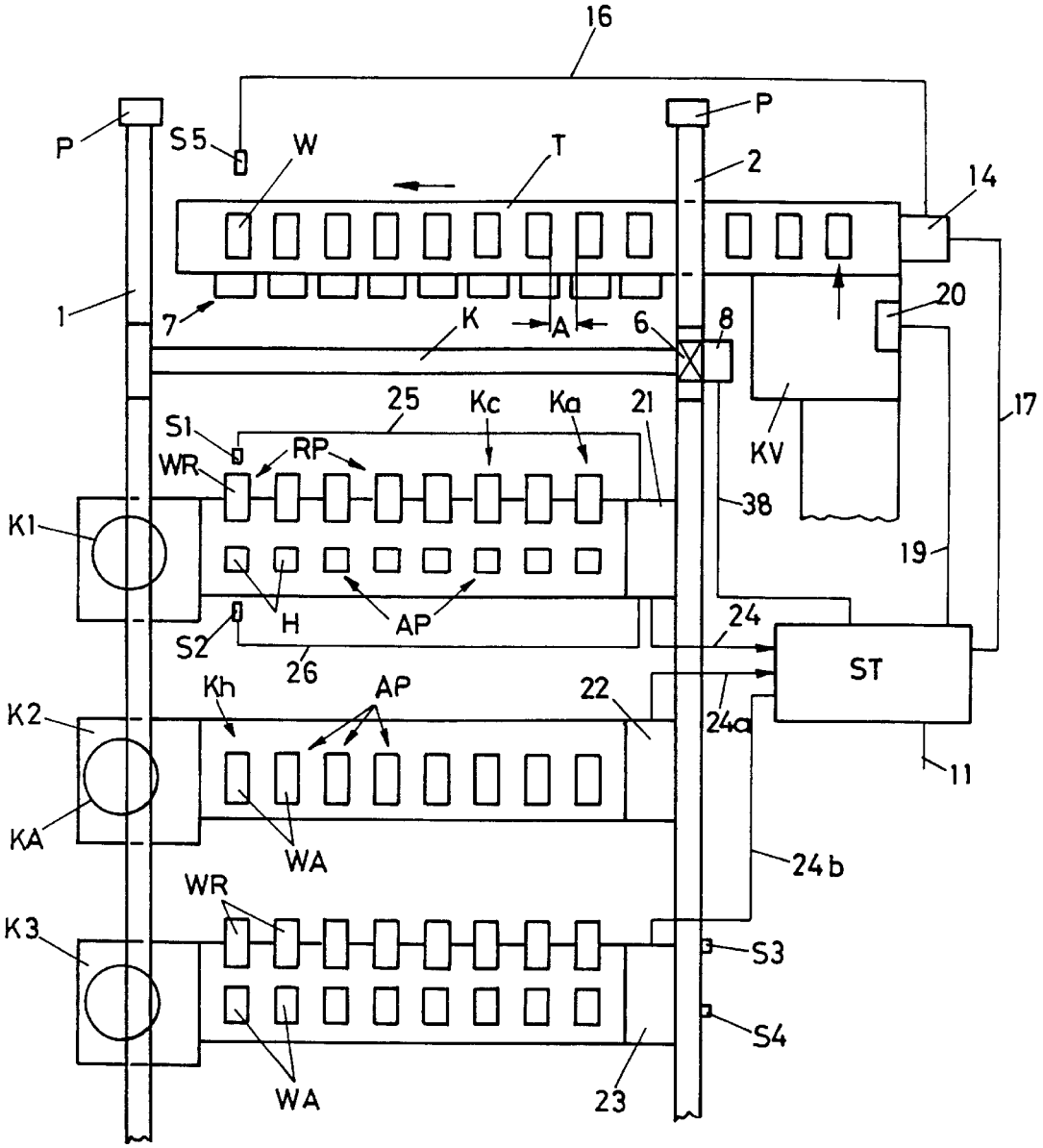
FIG. 1 shows a schematic representation of a combing plant with a conveying device in accordance with the invention.

FIG. 1 shows a top view of the combing plant with combing machines K1 to K3 positioned parallel to one another, a combing preparation KV and a conveying system K. Usually, six combing machines are assigned to a combing preparation. For reasons of clarity, however, only three combing machines thereof are shown. The conveying system consists in the indicated example of a displaceable crane bridge K which is guided on rails 1, 2 over the combing machines K1–K3 and is made to move via a schematically shown drive 6 whose control is performed by a control means 8. The rails 1 and 2 are supported on the floor by pillars P, of which only two are shown schematically.

Figure 3:
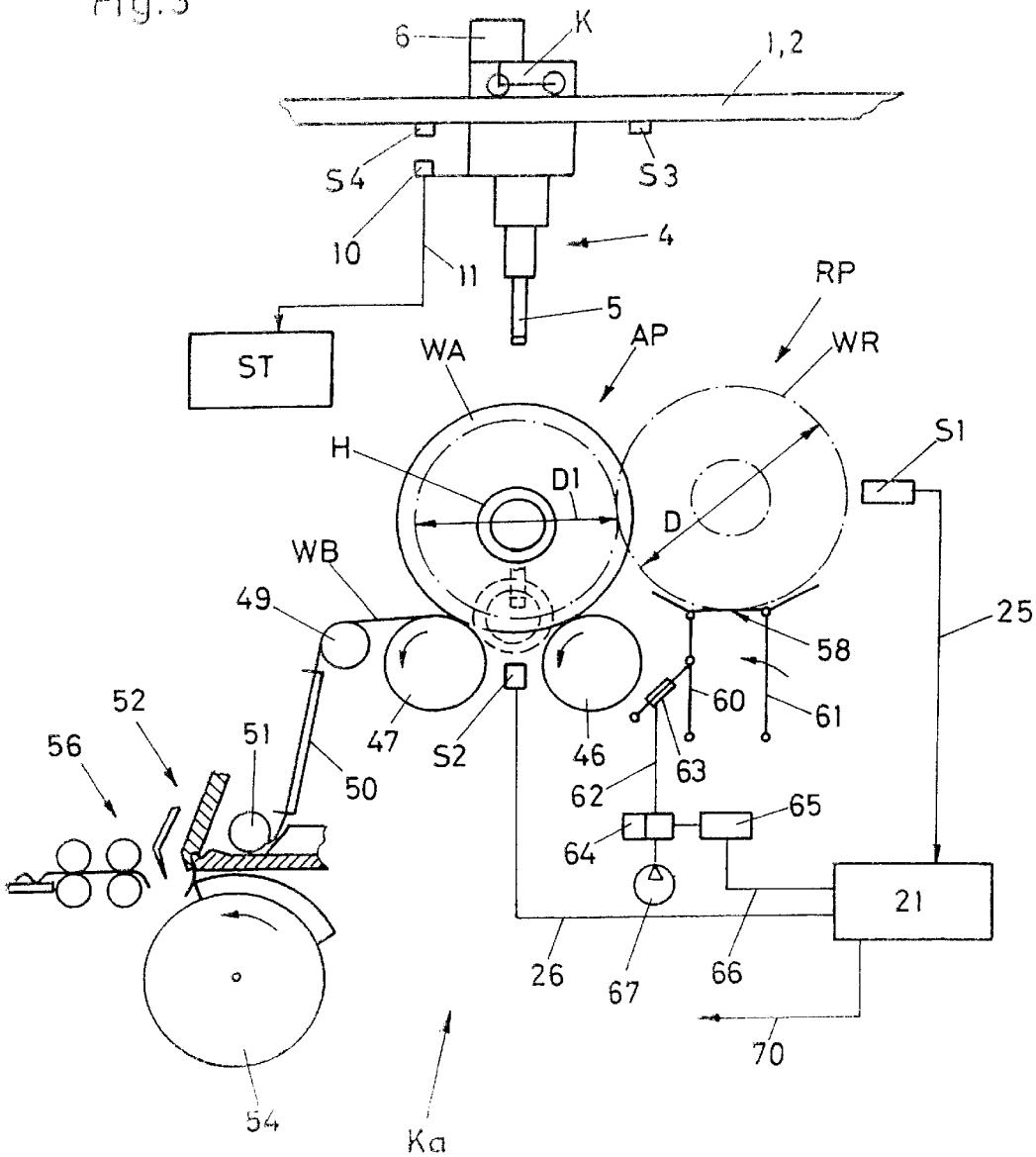
FIG. 3 shows a schematic side view of an embodiment in the area of a combing head of a combing machine.

The drive 6 is controlled via the control means 8 by a control unit ST and positioned by means of markings S3, S4 which are applied to rail 2. These markings are scanned by a sensor 10 which is fastened to crane bridge K. The signals of the sensor 10 are sent via a line 11 to the central control unit ST (FIG. 3). Such markings are applied on the rail 2 for each required positioning place, of which only two, namely S3 and S4, are shown as an example. This device allows positioning the crane bridge K above the reserve and working position RP and AP of the respective combing machine and above the conveyor belt T in order to perform respective conveying tasks.

The wound laps W which are formed on and ejected from the combing preparation KV are received by a conveyor belt T that functions as a buffer and displaced in the direction of the arrow. The transversal movement of the conveyor belt T whose drive (not shown) is controlled by a control unit 14 is chosen in such a way that the wound laps are placed in a row next to one another with a similar distance A in order to be taken up by the conveying system directly. This division of the wound laps W also corresponds to the division in the downstream combing machines K1 to K3. The row of wound laps W is associated with a sensor S5 which is connected with the control unit 14 via the line 16. The control unit 14 on its part is in connection via line 17 with the control unit ST which is in connection with the control unit 20 of the combing preparation KV via line 19. It is also possible to combine control units 14 and 20 in a common control unit. The shown linkage of the control units 14, 20 allows adjusting the movements of the conveyor belt T and the formation and the ejection of the wound lap W in the combing preparation precisely to one another. In the present case of FIG. 1, the capacity (storage) of the conveyor belt T is exhausted and it cannot take up any further wound laps before a row of laps (8 wound laps) has been received by the conveying system. The consequence is that although a wound lap W can be formed in the combing preparation KV, the delivery to the conveying system is prevented.

This fact is taken into account by the control unit ST and the system is controlled accordingly.

The conveying device consists of a movable crane bridge K on which a lowerable gripper device 4 is arranged which is provided with schematically shown grippers 5 (FIG. 3) in order to take up wound laps W or empty tubes H. In the present case, eight such grippers are provided in the conveying device. The drive 6 is also shown schematically which drives the drive wheels of the schematically shown traveling mechanism of the crane bridge K.

Figure 2:
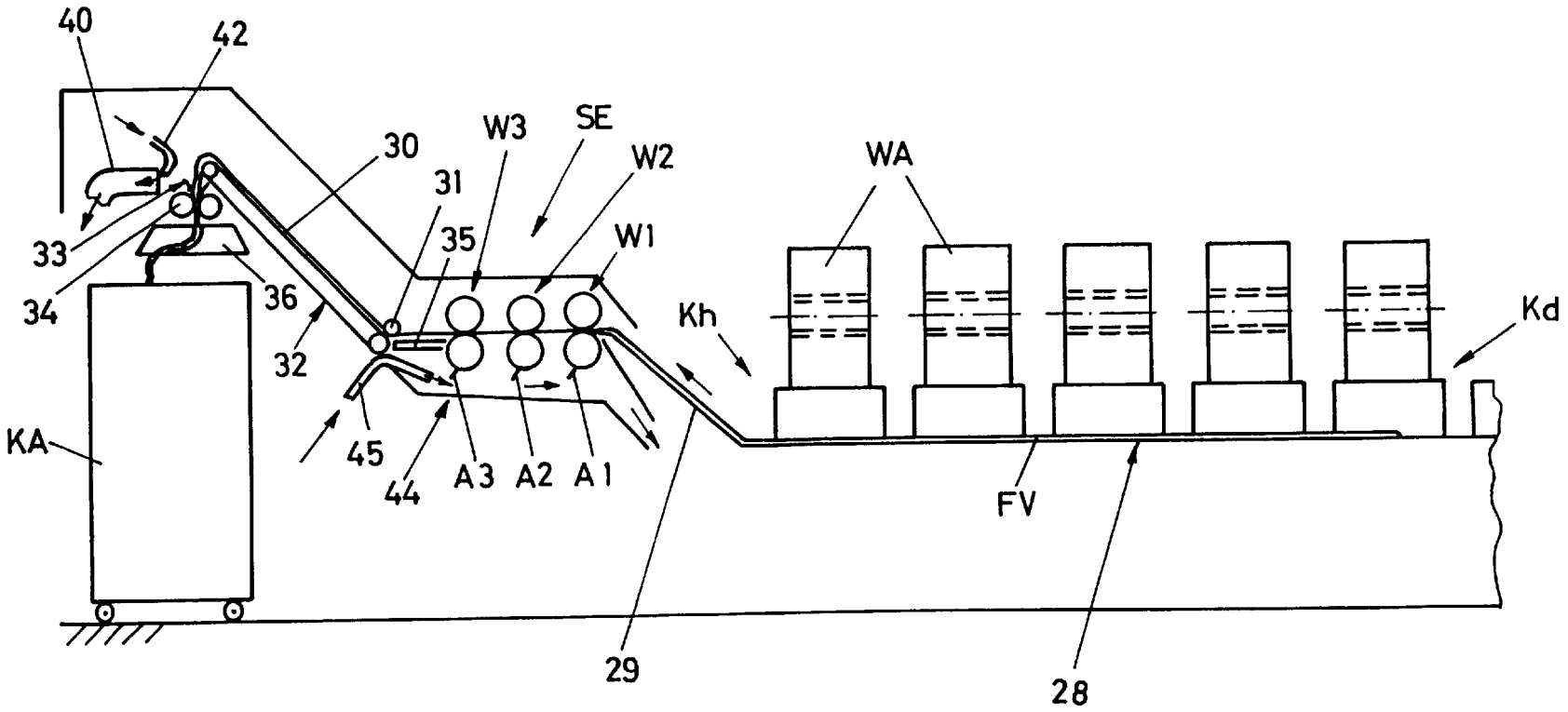
FIG. 2 shows a schematic representation of a combing machine in a side view.

FIG. 2 schematically shows a side view of a combing machine K1 which is provided with the combing heads Ka to Kh (of which only five are shown). The slivers supplied by the individual combing heads Ka to Kh are conveyed on a table 28 in the form of a nonwoven FV in the direction of a rising ramp 29. From there, the nonwoven FV reaches a drafting arrangement unit SE with successive pairs of rollers W1 to W3 in order to draft the nonwoven FV. The thus drafted fiber quantity is joined via a schematically shown nonwoven bowl 35 into a sliver 30 which is thereafter supplied to a conveyor belt 32. The conveyor belt 32 is provided during the transfer of the sliver with a pressure roller 31 and conveys the sliver 30 to a funnel 33 from which it is taken via calender rollers 34. The calender rollers transfer the sliver to a rotating funnel wheel 36 by means of which the sliver is deposited in loops in a downstream can KA. In order to keep the units in the zone of the funnel 33 and the calender rollers 34 clean from fiber fly and dust, a suction tube 40 is provided which is connected to a negative pressure source (not shown). It has been seen that over time dust and fiber fly can accumulate at the suction opening of the suction tube and can deposit there. This can lead to the consequence that the suction opening of the suction tube 40 is closed off to a large part and the suction effect is thus considerably impaired. In order to remedy this disadvantage, a blower nozzle 42 is provided in the zone of the suction opening through which the suction opening is cleaned of any accumulations by time defined air pulses.

A suction conduit 44 is arranged below the drafting rollers W1 to W3 which is also connected to a negative pressure source. This suction conduit 44 is used to suck off, especially the dirt stripped off by the roller strippers A1 to A3 and other fiber fly, and supply the dirt to a disposal device. It has been seen that the flow speed of the air in the zone of the stripper A3 is too low at the output of the drafting arrangement output, as a result of which dirt and fiber fly can accumulate in this zone too and can lead to malfunctions. It is therefore proposed that in the zone with the lower air flow where the stripper A3 is disposed, additional blower nozzles 45 (of which only one is shown) which are distributed over the width of the conduit 44 are provided which also keep this zone free from any accumulations by pulse-like air jets. Principally, such air nozzles can be used for support in a suction means wherever the existing suction device cannot remove and prevent any accumulations.

The combing machines K1 to K3 (FIG. 1) are each provided with a control unit 21, 22, 23 for controlling the machine in conjunction with a respective sensor system. Two such sensors S1 and S2 are shown as examples in the combing machine K1 which are connected with the control unit 21 via lines 25 and 26. Such a sensor can also be assigned to each combing head Ka to Kh. The presence of a reserve lap WR in the reserve position RP is monitored with the sensor S1. The progress of the processed lap WA is monitored with the sensor S2. If a tube with a black (dark) surface is used on which the lap is wound up, the winding process can be monitored with a b/w sensor, which means that once this sensor S2 recognizes the black surface of the tube H the combing process is interrupted by the control unit 21 and the disposal of the residual lap still present on the tube H is initiated and thereafter the change of the lap is performed which will be explained below in closer detail.

An additional sensor or monitoring system (not shown) is provided through which the presumable unwinding time of the wound lap WA is detected and is stored in the control unit ST. This sensor system can consist of a measuring system for detecting the unwinding length, or of a time detection system. In this way the job planning of the conveying system can be adjusted optimally by the control unit ST to the combing machines to be operated.

FIG. 3 shows the cross section of a combing head Ka, with a wound lap WA being unwound on two driven lap rollers 46, 47. The unwound web WB reaches a feed roller 51 of a nipper unit 52 via a roller 49 and a guide plate 50, which nipper unit performs an oscillating movement. In the shown closed state of the nipper 52, the fiber tuft projecting from the nipper is supplied to a clothing of a circular comb 54 for combing. The combed fiber tuft is thereafter supplied, when nipper 52 is opened, to a downstream pair of detaching rollers 56 where the piecing with the nonwoven is performed which is already disposed between the pair of detaching rollers. In this detaching process the fiber tuft is pulled through a schematically shown top comb.

A reserve lap WR can be placed on the receiver (bearing) 58 of the reserve position RP behind the wound lap WA which is disposed in the working position, as is shown with the dot-dash line. This can only be performed when the wound lap WA has been processed from the full diameter D to the diameter DI. As a result of this embodiment, the depth of the machine can be provided with a relatively compact design. The monitoring of the diameter D of the wound lap WA could be performed by a sensor (not shown) for example or indirectly via the unwinding length.

A design is also possible where the receiver 58 is arranged in such a way with respect to the lap rollers 46, 47, so that the full diameters D of the wound lap WA and the reserve lap WR do not overlap when they rest in the working position AP and in the reserve position RP. As a result, the follow-up of the new reserve lap WR can occur directly afterwards when the reserve lap WR disposed in the standby position RP has been transferred to the working position AP.

The sensor S2 for scanning the tube H is arranged between the lap rollers 46, 47. Sensor S1 monitors the presence of a reserve lap WR. The receiver 58 is swivelably held by means of the swiveling arms 60, 61. A cylinder 63 engages on the swiveling arm 60 by means of which the bearing 58 can be swiveled forwardly to transfer the reserve lap WR to the working position AP. A detailed description of this process is disclosed in EP-PS 593 391 for example.

The triggering of the cylinder 63 is performed via line 62 by a valve 64 which is pressurized with compressed air from a compressed air source 67. The control of the valve 64 is performed via the control element (e.g. electromagnet) 65 which is in connection with the control unit 21 via line 66. The line path 70 starting from the control unit 21 schematically shows the connection of the control unit 21 with the other units of the combing machine.

The conveying system with the crane bridge K and the gripper device 4 with the grippers 5 are positioned above the working position AP. This position is determined in the present example by scanning the marking S4 via the sensor 10 which is attached to the crane bridge K. The sensor 10 is connected via line 11 with the central control unit ST (it could also be connected via the control means 8 with the control unit ST). In order to position the conveying system above the reserve position RP, the marking S3 is brought to coincide with the sensor 10. The position of the markings S4, S3 and the other markings (not shown) above the other combing machines are stored in the control unit ST, so that when a wound lap is needed or when it is necessary to remove a tube, the conveying system can be positioned precisely and in time at the respective place. For example, such a positioning can also occur via respective code strips as has been shown and described in DE-A1 19646483. A device for positioning the crane bridge K could also be used, with the approach to a specific position being made by way of a length measurement from a fixed point. This can occur by using a laser beam for example.

The method for changing laps and for discharging empty tubes H will be explained below in closer detail.

FIG. 1 shows that the wound laps WA have run out in the combing machine K1 and only empty tubes H are disposed at the working position AP on the lap rollers 46, 47. This is recognized by at least one of the sensors S2 which are assigned to the individual combing heads Ka to Kh. This means that as soon as one of the sensors S2 recognizes the black surface of the tube, this is reported via line 26 to the control unit 21, whereupon the same stops the drive of the combing machine. Control unit 21 then initiates the automatic disposal of the residual lap still located on tube H, as has been described in EP-A1 455 171. It would also be possible to make this disposal manually. In the case of manual disposal, it is necessary to notify the control unit by manual acknowledgement that the disposal has been completed.

As soon as this disposal process is completed, the control unit 21 receives the signal that the tube H (or tubes H) are ready for collection. The control unit ST is informed about this by the control unit 21, which will then check the availability of the conveying system. When the conveying system is available, the control means 8 of the crane bridge K is triggered via line 38 and its drive 6 is put into operation.

As has already been described, information is stored in the control unit ST which report the presumable run-out of the lap to the individual combing machines. This allows bringing the crane bridge K already prematurely into a position from which the next following conveying order needs to be performed. Based on the information stored in the control unit ST, the crane bridge K is moved to the position as shown in FIG. 3 and positioned above the working position AP. Thereafter, the gripper unit 4 is lowered to the position as shown in FIG. 3 and positioned above the working position AP. Thereafter, the gripper device 4 is lowered until the grippers are able to engage in the inside clearance (i.e. the interior wall) of the of the tubes H which are shown with the broken line. The tubes H are then grasped by actuation of grippers 5 by means of a mechanism (not shown in closer detail), with one pair of grippers being swiveled into the tubes for example. Such solutions for grasping the tubes are generally known and will not be explained here in closer detail.

As soon as the tubes are grasped, the gripper device 4 is moved to an upper position which corresponds to the horizontal conveying position. The processes as explained above are detected by a sensor system (not shown in closer detail) and sent to the control unit ST. Once the tube H is located in the upper conveying position, the crane bridge K is made to move in the direction towards the conveyor belt T via the control unit ST and the control means 8 by means of drive 6 and positioned there accordingly in order to deliver the tubes via the schematically shown receivers 7 to the lower strand of the conveyor belt T. Such a receiving device is shown and explained in closer detail in DE-A1 197 20 545.

Once the tubes H have been transferred from the lap rollers 46, 47 to the upper conveying position (which is monitored with the respective sensor system), the transfer of the reserve lap WR to the working position AP is initiated by the control unit 21 of the combing machine K1. The cylinder 63 is actuated in this process, as a result of which the trough 58 swivels forwardly in the direction of the lap roller 46. As a result of this swiveling movement, the reserve lap WR rolls from a specific swiveling position to the working position AP and now lies on the lap rollers 46, 47. The lap end of the new working lap WA can now be pieced by hand or fully automatically to the trailing free end of the lap, as has been explained and described in EP-A1 455 171 for example.

As soon as the piecing process of the lap end has been completed, the processing process is started again in the combing machine by the control unit 21. Control unit 21 is informed via the sensor S1 that currently no reserve laps WR are on standby. As the new working laps WA have not yet been processed to diameter DI, the control unit 21 will notify the control unit ST of the lack of and need for reserve laps only when DI is reached. Once this state (DI) has been achieved, the control unit 21 demands via the control unit ST the re-supply of reserve laps WR. The control unit ST checks then whether the conveying system is available and whether a complete row (8 wound laps) of laps W are ready on the conveyor belt T for transfer. If this is the case, the group of laps W on standby is taken up by the conveying system and transferred to combing machine K1 to the reserve position on the receiving troughs 58. If the conveying system is then not available because another combing machine is being supplied, this order is placed in a queue and processed according to the priority of the tasks to be processed. There is usually still enough time to transfer the reserve laps WR to the combing machine K1 when the working laps WA have been processed to diameter DI.

The advantage of this method of the conveyance of wound laps and tubes is that no special intermediate storage of the empty tubes in the individual combing machines is necessary, because they are removed by the conveying system directly from the working position AP. Moreover, the reserves still present in the conveying system can thus be utilized even better. The conveying jobs are processed according to the defined priorities.

It is also possible, however, to provide further storage places for an intermediate storage of the empty tubes (H) in the zone of the conveyor belt (T) of the combing preparation (KV). This increases the availability of the conveying system, because the empty tubes discharged from the machines can immediately be supplied again or be intermediately stored.

Figure 4:
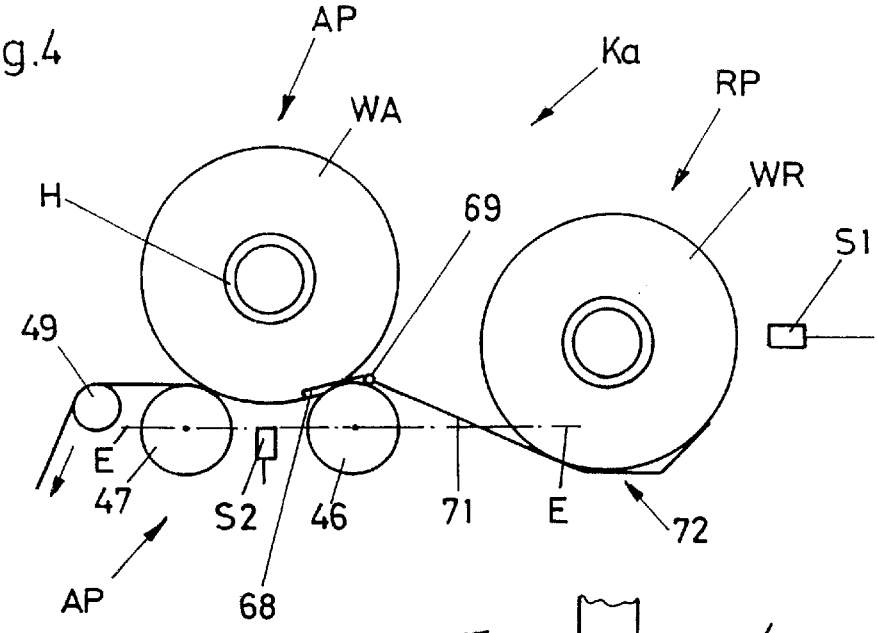
FIG. 4 shows a further embodiment according to FIG. 3.
Figure 5:
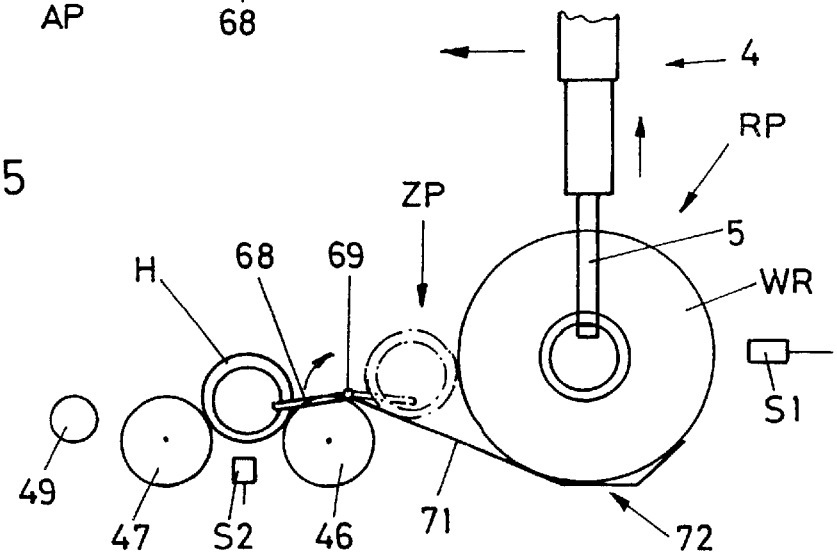
FIG. 5 shows a further view according to FIG. 4.
Figure 6:
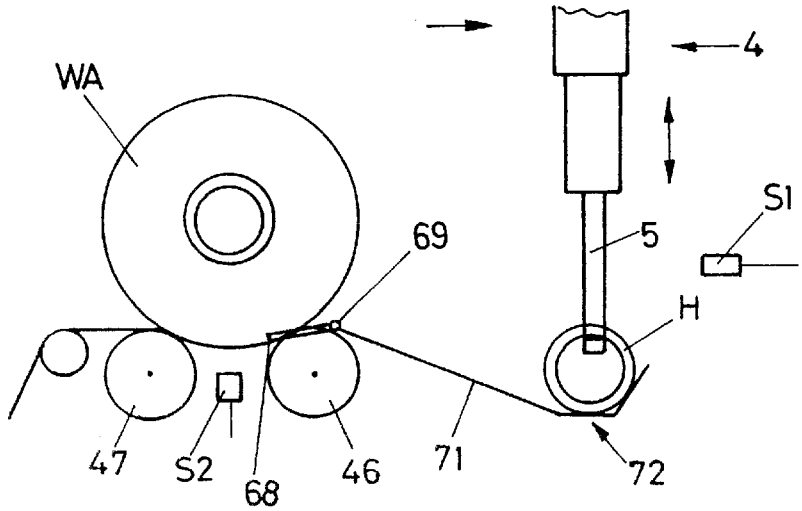
FIG. 6 shows a further view according to FIG. 4.

FIGS. 4 through 6 show a further alternative, with a common receiver 72 being provided for the reserve lap WR and the tube H discharged from the working position. This device is naturally present in all combing heads Ka to Kh.

In FIG. 4, the processed lap WA rests on the lap rollers 47, 46 and is unwound during the combing process. A reserve lap WR rests on standby behind the working lap WA in a receiver 72 which, as seen in the direction towards the rear lap roller 46, is provided with a guide means in the form of a ramp 71 which extends upwardly inclined. The receiver 72 is disposed below a plane E—E which is placed through the axes of rotation of the lap rollers 46, 47.

As has been described in the preceding example, a sensor S2 for scanning the tube is provided in the zone between the lap rollers 46, 47 and a sensor S1 for monitoring the reserve lap WR is provided in the zone of the reserve position RP. As soon as the sensor S2 recognizes the surface of the empty tube H, the machine is stopped via the control unit 21 of the combing machine KI and the holding elements of the tube gripper arm 68 are moved into the inside clearance of the tube H. The disposal of the residual lap still present on the tube H occurs now, as has been described and explained in EP-A1 455 171. The disposal of the residual lap could also be made manually, as has been described in the preceding example.

Once this disposal process has been completed, the gripper arm 68 is swiveled rearwardly to the position as shown in FIG. 5 with the broken line by means of an actuating device 69 (not shown in closer detail). In this way, the tube H reaches an intermediate position ZP and rests on the inclined progressing ramp 71. The gripper arm is thereafter moved out of the tube again, as a result of which the same rests freely on the ramp 71. As a result of said incline of ramp 71 the tube rolls in the direction towards the reserve lap WR until it comes to rest on the outside circumference of the reserve lap WR, thus preventing any further rolling off in the direction towards the receiver 72. A detailed description of the tube gripper 68 is shown and described in EP-PS 593 391 for example.

It would also be possible to provide a special adjustable stop (not shown) which projects into the zone of movement of the tube on ramp 71 and blocks the rolling off on the ramp before the tube comes to rest against the circumference of the reserve lap WR. This stop is then swiveled out of the zone of movement of the sleeve as soon as the reserve lap has been lifted off to a certain extent from the receiver 72 by the conveying system.

For this purpose, it would be necessary to provide a respective release mechanism which is actuated by the movement of the reserve lap WR and is in connection with the stop. In this manner, the stop is responsive to a transfer of a reserve lap from the receiver to allow movement of the empty tube into the receiver.

During the ejection of the tube, the conveying system was positioned by way of the central control unit ST above the reserve position and the gripper 5 was transferred downwardly in the zone of the inside clearance of the tube of the reserve lap WR. The lap WR is now lifted vertically and thereafter positioned by horizontal displacement above the working position AP. As a result of this displacement of the reserve lap WR, the tube H is now no longer blocked in its movement and rolls down the ramp 71 into the receiver 72. The reserve lap WR is now lowered by way of the conveying system onto the lap rollers 46, 47 and reaches the working position, as is shown in FIG. 6. The grippers 5 are extended again from the tube H of lap WA and moved upwardly. Now the new lap can be pieced manually or automatically (as described above) to the trailing end of the web. The procedure according to FIGS. 4 to 6 can be performed in all combing heads simultaneously.

The conveying system is thereafter moved to the position above the tubes H disposed in the receiver 72 and takes up the same with the grippers 5 in order to transfer them to the tube receiver 7 in the conveyor belt T. This transfer will only be performed, however, when there are no other jobs with a higher placed priority which need to be processed first by the conveying system. If this is the case in the present example, the return of the tubes H is made at a later time.

The conveying system is controlled or used via the control unit ST in such a way that no unnecessary standstills are produced in the combing machines and the combing preparation.

As soon as the tubes have been disposed of from the position as shown in FIG. 6, a new group of wound laps can be transferred as reserve laps WR to receiver 72 by means of the conveying system.

With the further embodiments shown (FIGS. 4 to 6), it is possible to provide a common receiver for the reserve laps WR and the ejected tubes H. Moreover, no special transfer apparatus for the transfer of the reserve laps WR to the working position is required because this task is assumed by the conveying system. In this solution too, a partial task is assigned to the conveying system as compared with previously known solutions, thus providing the same with an improved capacity utilization.

What is claimed is:

1. An apparatus comprising a lap forming machine for forming wound laps on tubes, said machine including a control unit for operating said machine;

a conveyor for receiving a plurality of wound laps from said lap forming machine;

at least one combing machine having at least one working head with a reserve position for receiving a wound lap from said conveyor, said combing machine including at least one transfer device for moving a wound lap from said reserve position to a working position in said working head and a control unit for operating said combing machine and for operating said transfer device;

a conveying system for selectively conveying at least one wound lap from said conveyor to said combing machine and at least one empty tube from said combing machine to said conveyor, said conveying system including a control unit for operating said system; and a central control unit operatively connected to each said control unit for selective actuation thereof to effect movement of at least one wound lap from said lap forming machine to said reserve position, removal of an empty tube from said working position to said conveyor and movement of a wound lap from said reserve position to said working position.

2. An apparatus as set forth in claim 1 further comprising sensor means for monitoring a run out of a lap from a wound lap in said working position and emitting a signal in response to an interruption thereof.

3. An apparatus as set forth in claim 1 further comprising sensor means for monitoring the presence of a wound lap in said reserve position.

4. An apparatus as set forth in claim 1 wherein said combing machine has a plurality of said transfer devices operable in simultaneous manner to transfer a plurality of wound laps from a reserve position thereof to a respective working position.

5. An apparatus as set forth in claim 1 wherein said conveying system includes a crane bridge disposed over said combing machine for horizontal movement relative thereto, said crane bridge being operatively connected to said central control unit for actuation thereby to move relative to said combing machine.

6. A method for automatic transfer of wound laps to a lap processing machine comprising the steps of actuating a conveying system to automatically place a reserve wound lap in a reserve position of the lap processing machine;

thereafter monitoring the run-out of a wound lap in a working position of the lap processing machine and emitting a signal in response to the detection of an empty tube in said working position;

actuating the conveying system to remove the empty tube from said working position in response to said signal;

actuating the conveying system to transfer the reserve wound lap from said reserve position to said working position; and actuating the conveying system to move a fresh wound lap into said reserve position.

7. A method for automatic transfer of wound laps in a lap processing machine comprising the steps of actuating a conveying system to automatically place a reserve wound lap in a reserve position of the lap processing machine;

thereafter monitoring the run-out of a wound lap in a working position of the lap processing machine and emitting a signal in response to the detection of an empty tube in said working position;

actuating the conveying system to remove the empty tube from said working position to an intermediate position defined by the position of the reserve lap in response to said signal;

actuating the conveying system to transfer the reserve wound lap from said reserve position to said working position and to allow automatic transfer of the empty tube from said intermediate position into said reserve position; and actuating the conveying system to remove the empty tube from said reserve position.

* * * * *